US012005285B2

(12) United States Patent
Herring et al.

(10) Patent No.: US 12,005,285 B2
(45) Date of Patent: Jun. 11, 2024

(54) MODULAR CABLE-BASED RESISTANCE WORKOUT DEVICE

(71) Applicant: Anchor Health and Fitness, Inc., Swampscott, MA (US)

(72) Inventors: Arthur N. Herring, Swampscott, MA (US); Isaac E. H. Lewis, Windsor (CA)

(73) Assignee: Anchor Health and Fitness, Inc., Salem, MA (US)

( * ) Notice: Subject to any disclaimer, the term of this patent is extended or adjusted under 35 U.S.C. 154(b) by 91 days.

(21) Appl. No.: 17/673,235

(22) Filed: Feb. 16, 2022

(65) Prior Publication Data

US 2022/0168606 A1 Jun. 2, 2022

Related U.S. Application Data

(63) Continuation-in-part of application No. PCT/US2020/046382, filed on Aug. 14, 2020.

(60) Provisional application No. 62/888,138, filed on Aug. 16, 2019.

(51) Int. Cl.
*A63B 21/00* (2006.01)
*A63B 21/02* (2006.01)

(52) U.S. Cl.
CPC ..... *A63B 21/00065* (2013.01); *A63B 21/025* (2013.01); *A63B 21/153* (2013.01)

(58) Field of Classification Search
CPC . A63B 21/00065; A63B 21/02; A63B 21/023; A63B 21/025; A63B 21/026; A63B 21/04; A63B 21/0407; A63B 21/0414; A63B 21/0435; A63B 21/151;
(Continued)

(56) References Cited

U.S. PATENT DOCUMENTS 4,815,731 A * 3/1989 Suarez ..... A63B 21/055 482/126
5,360,382 A 11/1994 Chi
(Continued)

FOREIGN PATENT DOCUMENTS

KR 10-1792216 B1 11/2017

OTHER PUBLICATIONS

Columbia Basin, HMPE, Dyneema & Spectra Ropes [online], Published Jan. 3, 2018. Retrieved from the Internet <URL: https://web.archive.org/web/20180103195130/http://cbknot.com/dyneema-spectra-HMPE (Year: 2018).*
(Continued)

*Primary Examiner* — Zachary T Moore
(74) *Attorney, Agent, or Firm* — Burns & Levinson LLP; Rebecca C. Christon

(57) ABSTRACT

Cable training devices are disclosed that are modular, lightweight, and portable. The disclosed cable training devices can be mounted to virtually any accessible surface or object via a modular mounting platform. The cable training devices include a base unit that is easily attachable to and removable from one or more modular spring plates that provide resistance. The base unit contains a reel or spool with a cable wound around it. Pulling on the cable is resisted by the attached modular spring plates, which each contain a coil or power spring. The modular spring plates can be added or removed from the base unit to vary the resistive force applied to the cable.

16 Claims, 9 Drawing Sheets

(58) Field of Classification Search
CPC ..... A63B 21/153; A63B 21/157; A63B 21/22; A63B 21/222
See application file for complete search history.

(56) References Cited

U.S. PATENT DOCUMENTS

| | | | | |
|---|---|---|---|---|
| 5,733,231 | A * | 3/1998 | Corn | A63B 21/153 482/127 |
| 6,685,602 | B2 * | 2/2004 | Colosky, Jr. | A63B 23/00 482/904 |
| 6,929,589 | B1 * | 8/2005 | Bruggemann | A63B 21/025 482/904 |
| 7,087,001 | B1 | 8/2006 | Ihli | |
| 9,320,936 | B1 | 4/2016 | Rea | |
| 10,343,006 | B2 * | 7/2019 | Francis | A63B 21/045 |
| 10,556,143 | B2 * | 2/2020 | Sherin | A63B 21/00065 |
| 2009/0227433 | A1 | 9/2009 | Humble et al. | |
| 2014/0357457 | A1 | 12/2014 | Boekema et al. | |
| 2017/0368401 | A1 | 12/2017 | Francis et al. | |
| 2019/0001175 | A1 | 1/2019 | Wagner et al. | |

OTHER PUBLICATIONS

Supplementary European Search Report and Opinion in EP Application No. 20854047.6, dated Aug. 30, 2023, 6 pages.

* cited by examiner

MODULAR CABLE-BASED RESISTANCE WORKOUT DEVICE

CROSS-REFERENCE TO RELATED APPLICATIONS

This application is a bypass Continuation-In-Part (CIP) application of and claims priority to International Patent Application Number PCT/US2020/46382 filed Aug. 14, 2020, which claims the benefit of U.S. Provisional Patent Application No. 62/888,138 filed Aug. 16, 2019, the entire contents of which are incorporated by reference herein.

FIELD

The present disclosure relates, generally, to workout and physical therapy devices and, more particularly, relates to modular and portable devices using a cable to provide variable resistance levels as well as related methods.

BACKGROUND

Conventional workout devices are known to include a vertically aligned frame that accommodates a weight stack attached via and cable and pulley system to one or more handles. The cable runs through an adjustable pulley system, allowing the handle grip to be pulled from a desired height. The user selects the desired resistance by inserting a fastener (e.g., a pin or other type of locking mechanism) into one of the weights in the stack and that weight along with all overlying weights are lifted by the user to provide resistance to the cable. Conventional workout devices are used for exercise, strength training, and physical therapy.

Although effective for providing resistance, these conventional workout devices are very cumbersome and have many shortcomings. For example, the conventional devices are very large, sometimes having dimensions of between 6-8 feet wide, 7-8 feet tall, and 3-5 feet deep. The machines are also very heavy and, depending on how many weights are included in the weight stack, the machines can weigh more than 600 pounds. Additionally, conventional devices are difficult to store in a compact manner and usually require substantial space to store in a home setting. The heavy and bulky nature of conventional workout machines makes them impractical for home use.

SUMMARY

Given the impracticality of moving and storing conventional cable resistance workout machines in the home, there is a need for cable strength training devices that are easily movable and able to be compactly stored in a home setting, for saving space in a physical therapy clinic, or as a portable medical device. The presently disclosed devices can be used in many different types of settings and for various purposes, including but not limited to sports and athletic training, home fitness, gyms, and for strength and conditioning purposes. The presently disclosed cable training devices are modular and capable of delivering a cable workout similar to that of gym equipment using a lightweight and portable device.

The disclosed cable training devices include a base unit that is easily attachable to and removable from modular spring plates that provide resistance. The devices can be mounted on virtually any accessible surface via a modular mounting platform. The base unit of the cable training devices contains a reel or spool with a low-stretch cable wound around it. Pulling on the cable is resisted by the attached modular spring plates, which each contain a coil or power spring. The modular spring plates can be added or removed from the base unit to vary the resistive force applied to the cable. The internal configuration of the stackable modular spring plates creates equal tension of the cable during both extension and retraction of the cable.

A modular resistance device is disclosed that includes a base unit and at least a first modular spring plate. The base unit includes a cable wound around a spool and a recoil spring coupled to the spool such that the recoil spring exerts a resistive force upon the spool to resist unwinding of the cable from the spool. The first modular spring plate includes a power spring mounted on a shaft. The first modular spring plate is couplable to and decouplable from the base unit, and the resistive force applied to the cable increases when the first modular spring plate is coupled to the base unit and the resistive force applied to the cable decreases when the first modular spring plate is decoupled from the base unit.

In some embodiments, the base unit also includes a housing, the spool is retained within the housing, and the cable extends at least partially outside of the housing. In these and other embodiments, the spool has an axis shaped to mate with an axis of the first modular spring plate. In some such embodiments, the axis of the spool is shaped as a female polygon and the axis of the first modular spring plate is shaped as a mating male polygon.

In some embodiments, the modular resistance device also includes a second modular spring plate that includes a power spring mounted on a shaft. In some such embodiments, the first modular spring plate is attachable to a first side of the base unit and the second modular spring plate is attachable to a second side of the base unit and the first side of the base unit is opposite the second side of the base unit.

In some embodiments, the shaft of the first modular spring plate includes a male polygon profile on a first side of the first modular spring plate and a female polygon profile on a second side of the modular spring plate opposite the first side. In some such embodiments, the first side of the modular spring plate is directly attachable to and removable from the base unit. In these and other embodiments, the modular resistance device also includes a second modular spring plate attachable to and removable from the first modular spring plate or the base unit, wherein the second modular spring plate includes a power spring mounted to a shaft and the shaft includes a male polygon profile configured to mate with the female polygon profile of the first modular spring plate or a female polygon profile of the spool of the base unit.

In some embodiments, the spool of the base unit has a tapered barrel. In these and other embodiments, the base unit is couplable to and removeable from a modular mount. In some such embodiments, the modular mount is selected from the group consisting of: a physical wall mount, an easy on/off magnet mount, a pole mount, a post mount, a tree mount, a fence mount, and a suction cup.

In some embodiments, the first modular spring plate is attachable to the base unit with interlocking ball detents and mating tabs. In these and other embodiments, the cable in implemented with a high-modulus polyethylene (HMPE). In select embodiments, the cable includes an HMPE core with a polyester cover. In these and other embodiments, the cable has a length of between six and twelve feet.

The presently disclosed cable training devices are modular in nature. In particular, the base unit of the device can be used with a variable number of modular spring plates to set the resistance of the cable at a desired level. In contrast to conventional cable training devices that contain a very heavy stack of internal weights at all times, the disclosed modular cable training device is easily customizable and only requires a minimum amount of weight to achieve the desired amount of resistance. Also, the mechanisms employed by the disclosed cable training devices significantly reduce the overall weight of the device, making it easily portable. Specifically, while conventional devices rely on simply the weight of stacked metal components for cable resistance, the disclosed cable training devices apply resistive force using torque from various springs or other mechanisms inside the device, making the devices lightweight and facilitating customized resistance since the modular spring plates to be added or removed are not heavy.

BRIEF DESCRIPTION OF THE DRAWINGS

Many aspects of the disclosure can be better understood with reference to the following drawings. The components in the drawings are not necessarily to scale, emphasis instead being placed upon clearly illustrating the features of example embodiments. Moreover, in the drawings, like reference numerals designate corresponding parts throughout the several views.

FIG. 1A illustrates a perspective view of the cable training device and FIG. 1B illustrates an exploded view of the cable training device shown in FIG. 1A.

FIG. 3A illustrates a perspective view of a modular spring plate, FIG. 3B illustrates a cross-sectional view of the modular spring plate shown in FIG. 3A in a first embodiment, and FIG. 3C illustrates a cross-sectional view of the modular spring plate shown in FIG. 3A in a second embodiment.

FIG. 5A illustrates a perspective view of an assembled track mount device and FIG. 5B illustrates an exploded side view of the track mount device shown in FIG. 5A.

FIG. 6A illustrates a perspective view of a strap mount device and FIG. 6B illustrates an exploded view of the strap mount device shown in FIG. 6A.

DETAILED DESCRIPTION

The presently disclosed cable training devices address several issues with previous designs. Specifically, in the disclosed cable training devices, modular spring plates provide customizable resistance levels without the need for physical weights. The modular spring plates are stackable and create equal tension on the cable during both extension and retraction of the cable. Also, the disclosed cable training devices can be mounted using various types of modular mounts, enabling the devices to be portable rather than stationary. The cable training devices are also compact in size and lightweight, allowing for easy transport and use. Exemplary structures of the disclosed cable training devices and related methods are discussed in the following sections.

Exemplary Structures

Figure 1A:
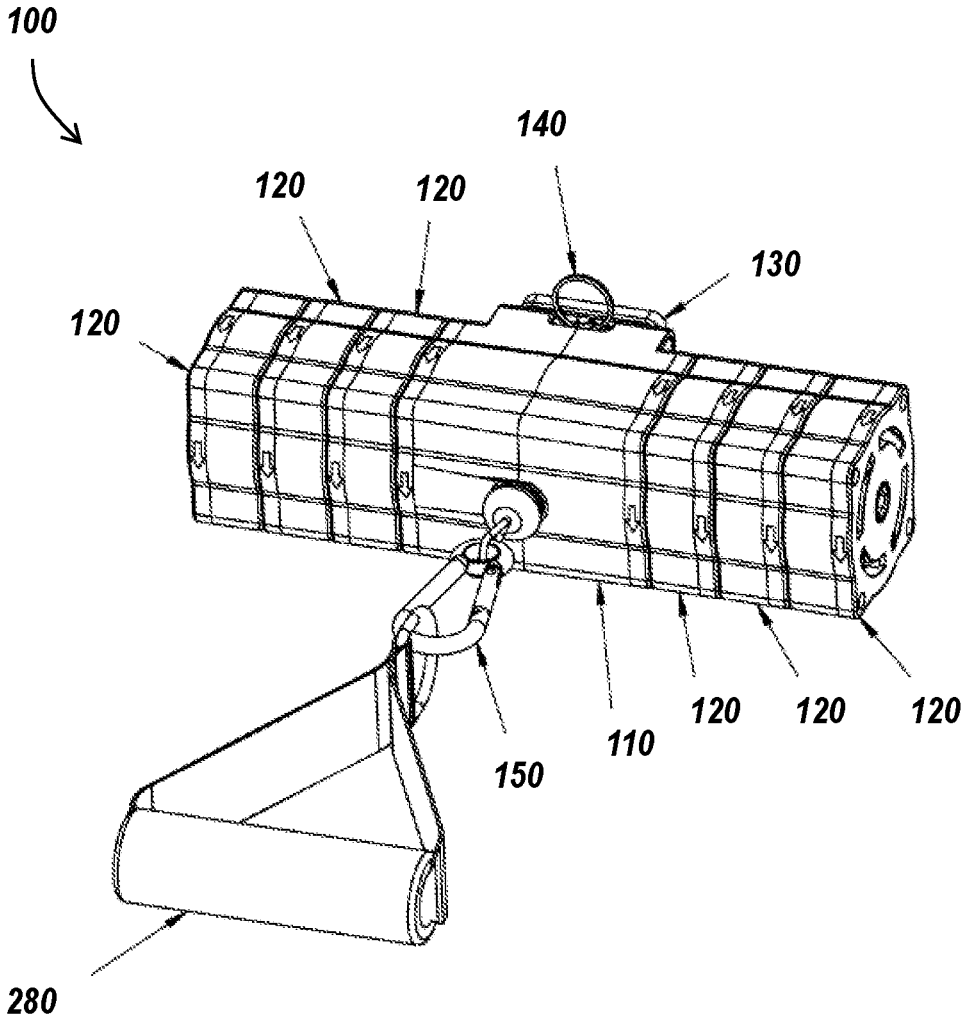
FIGS. 1A and 1B illustrate an exemplary cable training device configured in accordance with some embodiments of the subject disclosure. In particular.
Figure 1B:
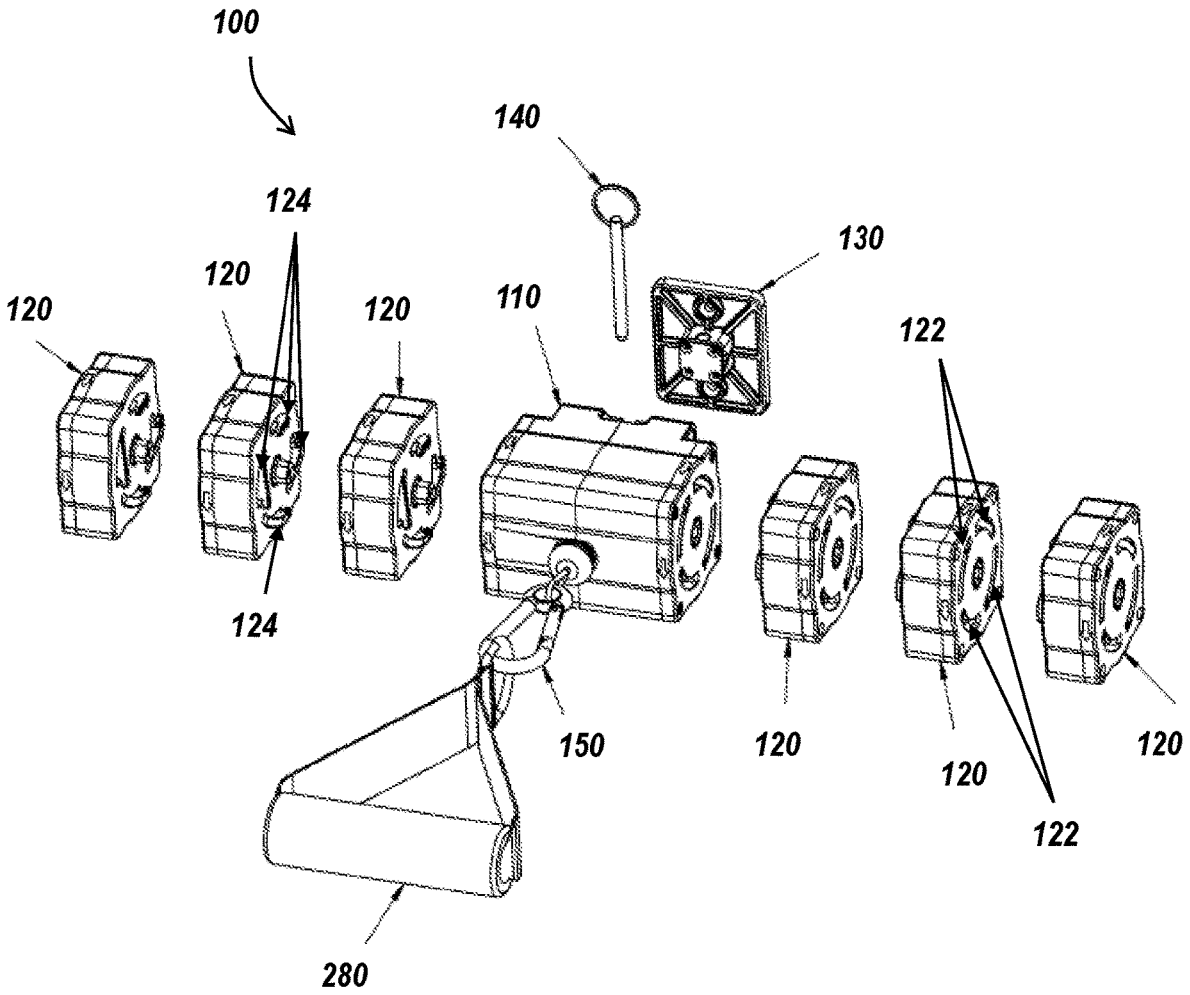
Figure 2A:
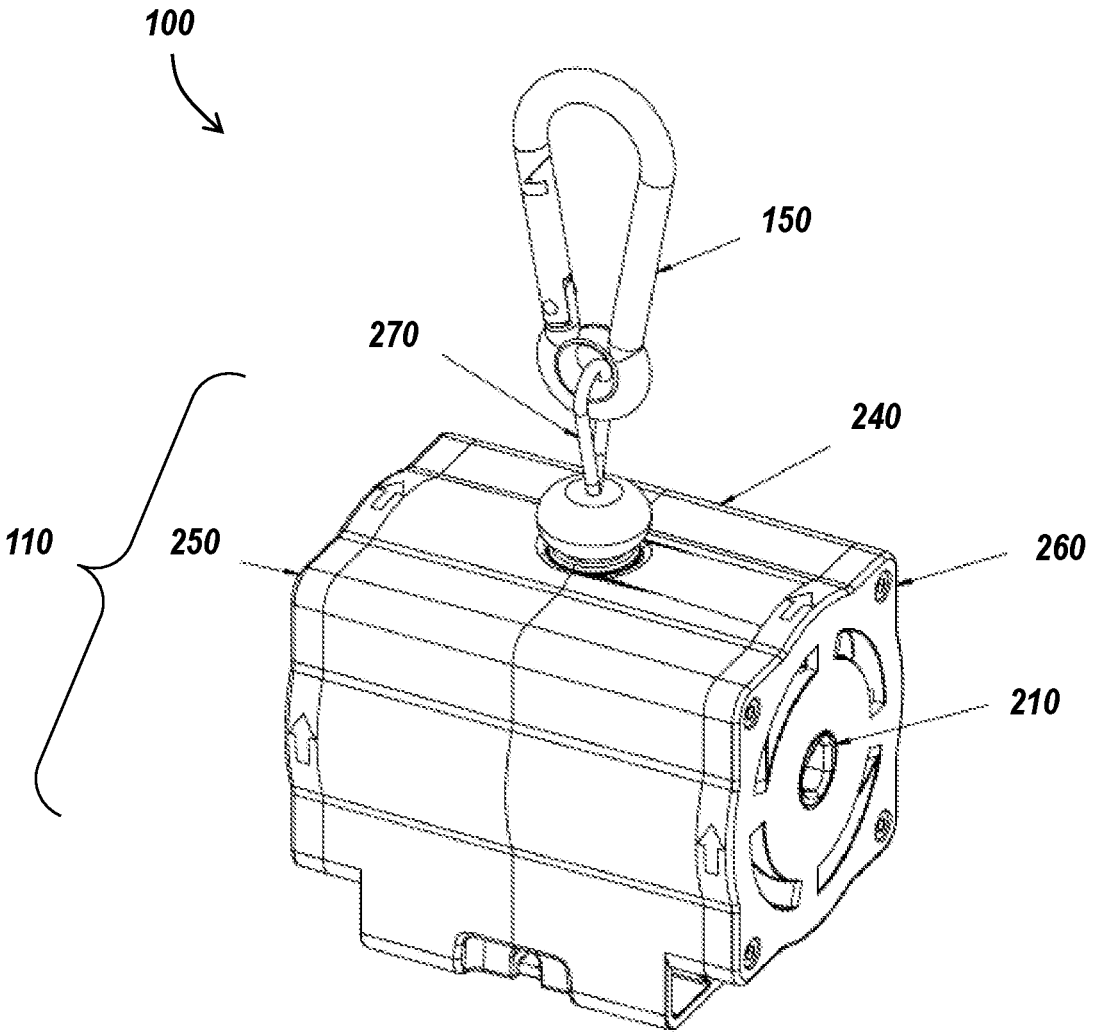
FIGS. 2A and 2B illustrate an exemplary cable training device, with FIG. 2A illustrating a perspective view of the device in which external components of a base unit are shown, and FIG. 2B illustrating a cross-sectional view of the device shown in FIG. 2A.
Figure 2B:
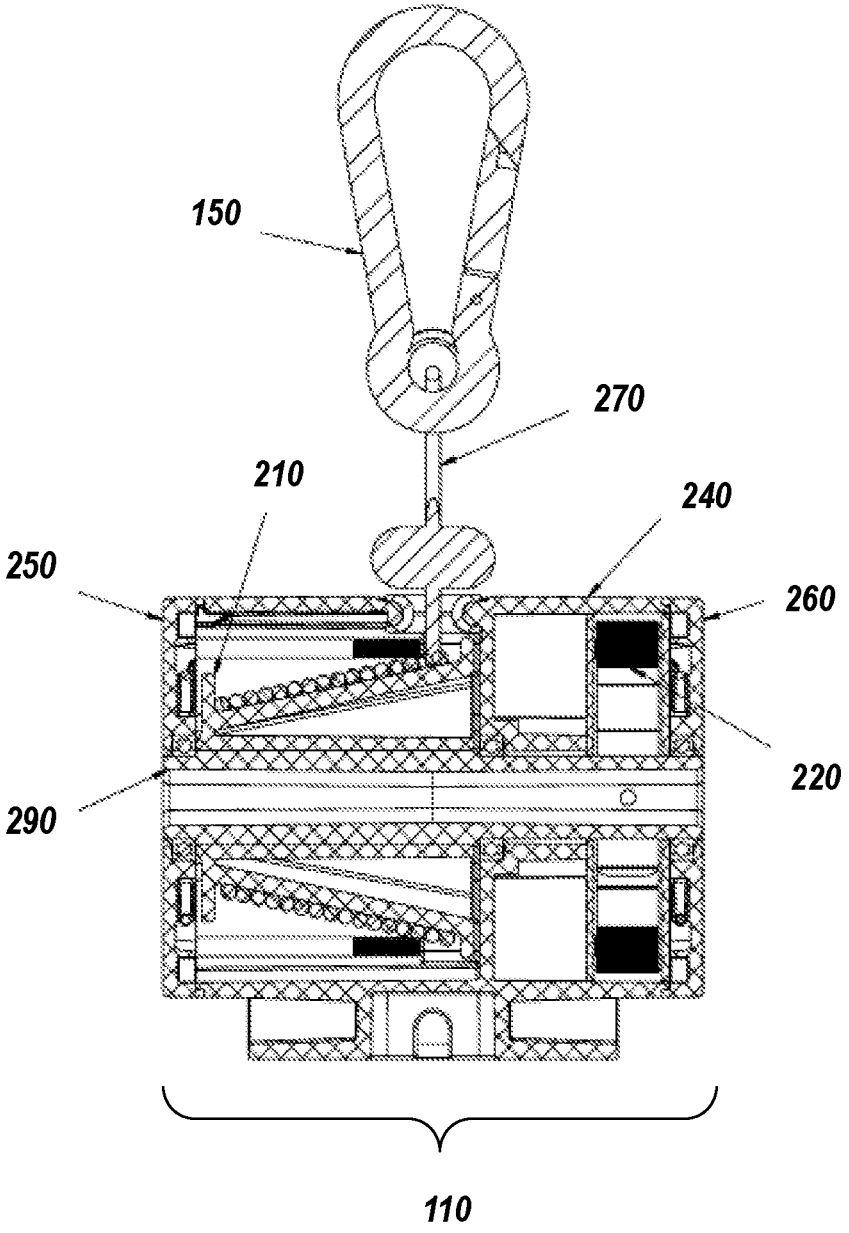

FIGS. 1 and 1B illustrate an exemplary cable training device 100 configured in accordance with some embodiments of the subject disclosure. As shown in FIGS. 1A and 1B, the cable training device 100 includes a base unit 110, which contains a spool and a recoil spring. Details of the base unit 110 are shown in FIGS. 2A and 2B and discussed in the following paragraphs. The cable training device 100 also includes one or more modular spring plates 120 which can each be physically coupled to the base unit 110. As will be appreciated, coupling additional modular spring plates 120 to the base unit 110 increases the resistance of the device.

As shown in FIGS. 1A and 1B, a fastener 140 attaches the base unit 110 to a modular mount 130. In some embodiments, fastener 140 may be a pin or another type of locking fastener, such as a bolt, anchor bolt, screw or other suitable type of fastener. Modular mount 130 may be any desired type of mount. For example, in some embodiments, modular mount 130 may be a physical wall mount, an easy on/off magnet mount, a pole mount, a post mount, a tree mount, a fence mount, and/or other type of mount. In select embodiments, modular mount 130 may be a commercial-grade suction cup, which can be appropriate for relatively smooth surfaces. In embodiments in which the modular mount 130 is a suction cup mount, the modular mount 130 may have a 6" diameter, a holding capacity of at least 210 pounds, a manual pump to remove pressure between the mounting surface and the suction cup, and/or a colored indication band to signal whether additional suction is needed to properly secure the suction cup to the mounting surface.

FIGS. 1A and 1B illustrate an example connector 150 that can be coupled to a cable exiting from the base unit 110. It should be appreciated that the example connector 150 shown in FIGS. 1A and 1B is in the form of a carabiner, but in other embodiments, a different type of connector 150 may be used. Connector 150 may be used to couple the cable to a desired piece of equipment. For example, as shown in FIGS. 1A and 1B, connector 150 is used to couple the cable to a handle 280. Alternatively, in other embodiments, the cable may be directly to a handle 280 or another type of equipment.

FIGS. 2A and 2B illustrate features of device 100 and, more particularly, base unit 110 in greater detail. As shown in FIGS. 2A and 2B, the base unit 110 includes a housing containing various components stored therein. In the exemplary embodiment shown in FIGS. 2A and 2B, the housing is formed of three distinct housing components: 240, 250, and 260, but in other embodiments, more or less housing components may be used to form the housing of the base unit 110. As shown in FIGS. 2A and 2B, the housing of the base unit 110 is assembled by attaching two outer housing components 250, 260 to a central housing component 240. These housing components may be attached, in some embodiments, using threaded screws, bolts, or other suitable fasteners.

A cable 270 is retained at least partially within the base unit 110 and is attachable to a handle 280 or another type of equipment pieces, such as a bar, rope, or other type of gripping component. In some embodiments, a connector 150 may be used to facilitate attachment of a handle 280 or other type of equipment to the cable 270. As shown in FIG. 2B, cable 270 is wound around spool 210. In some embodiments, spool 210 may have a tapered barrel. In some such embodiments, the tapered barrel of the spool 210 may permit the cable 270 to be wound and unwound smoothly by ensuring the cable is wound and unwound in an orderly manner on the barrel.

As shown in FIG. 2B, recoil spring 220 is coupled to spool shaft 290, which is coupled to spool 210 and exerts a force upon spool 210 to wind cable 270 into the base unit 110. In some embodiments, such as shown in FIG. 2B, spool 210 includes a distinct shaft 290 component, but other configurations are also possible, such as a spool having an integral shaft. As referred to herein, the term "spool 210" should be understood to include embodiments in which the spool 210 includes a distinct spool shaft 290, as shown in FIG. 2B, as well as other possible configurations. Recoil spring 220 may be coupled to spool 210 using any suitable fastener. For example, in some embodiments, a pin or a screw fastener may be used to attach the spool 210 to the recoil spring 220. However, in other embodiments, spool shaft 290 may couple the spool 210 to the recoil spring 220. In some embodiments, the recoil spring 220 may be formed of stainless steel (e.g., Type 301 stainless steel) or another type of high-carbon steel, as desired. As will be appreciated upon consideration of the subject disclosure, various additional components may be present inside the base unit 110 to facilitate functioning of the device 100, such as bearings and/or screws.

Cable 270 may be constructed from any suitable material (s) and, in some embodiments, may be implemented with a material having high strength and a low ability to stretch. In select embodiments, the cable 270 is implemented with ultra-high-molecular-weight polyethylene (UHMWPE), also known as high-modulus polyethylene (HMPE). In these and other embodiments, cable 270 may be braided or double braided. If desired, cable 270 may be coated with a polymeric cover, such as polyester.

In some embodiments, cable 270 may have a length of at least four feet, six feet, eight feet, ten feet, twelve feet, or fourteen feet. In these and other embodiments, cable 270 may have a length of less than fourteen feet, twelve feet, ten feet, or eight feet. In select embodiments, cable 270 may have a length of between 4-14 feet, 6-12 feet, or 7-10 feet. In one particular embodiment, cable 270 is approximately or exactly 8.5 feet in length.

As previously mentioned, the base unit 110 may be coupled to one or more modular spring plates 120, as shown in FIG. 1. In some embodiments, spool 210, or particularly spool shaft 290, may include features to facilitate attachment and removal of modular spring plates 120. For example, in some embodiments, the axis of the spool 210 (e.g., spool shaft 290) may include a female polygonal shape configured to receive mating features of a male polygonal shape included on a modular spring plate 120. However, other variations in connective features of the spool 210 and/or spool shaft 290 and modular spring plates 120 are also possible and contemplated herein.

Figure 3A:
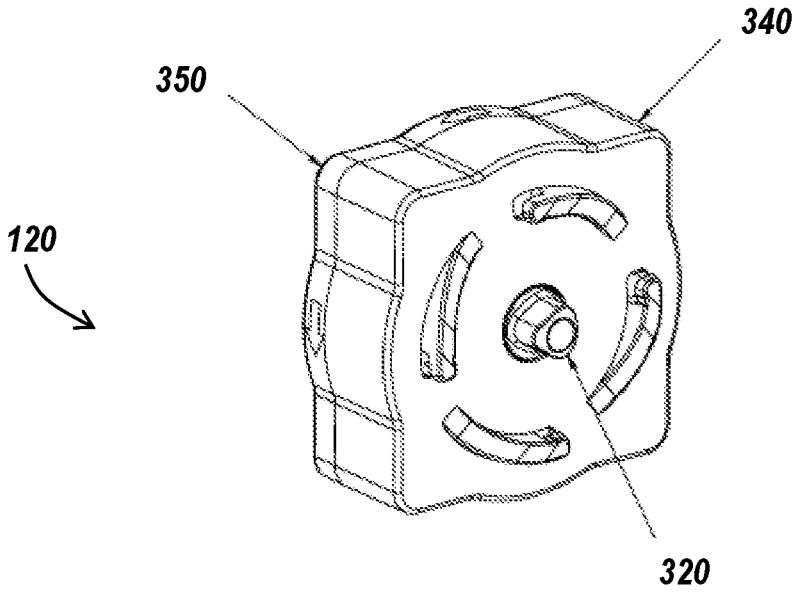
FIGS. 3A-3C illustrate exemplary modular spring plate configurations in accordance with some embodiments of the subject disclosure. In particular.
Figure 3B:
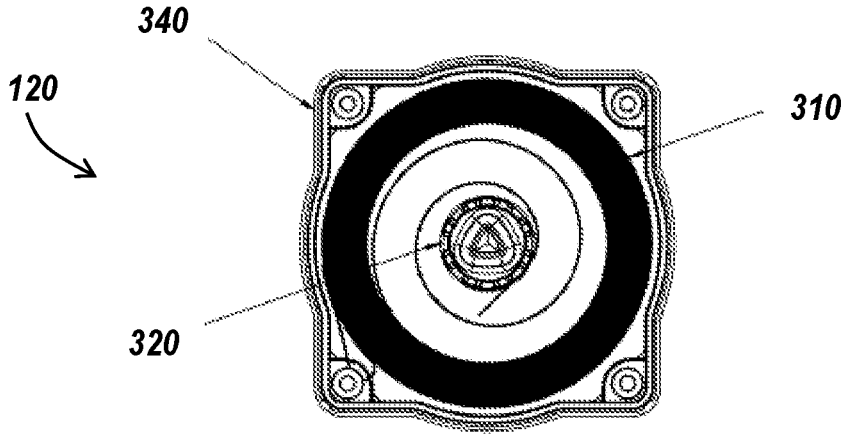
Figure 3C:
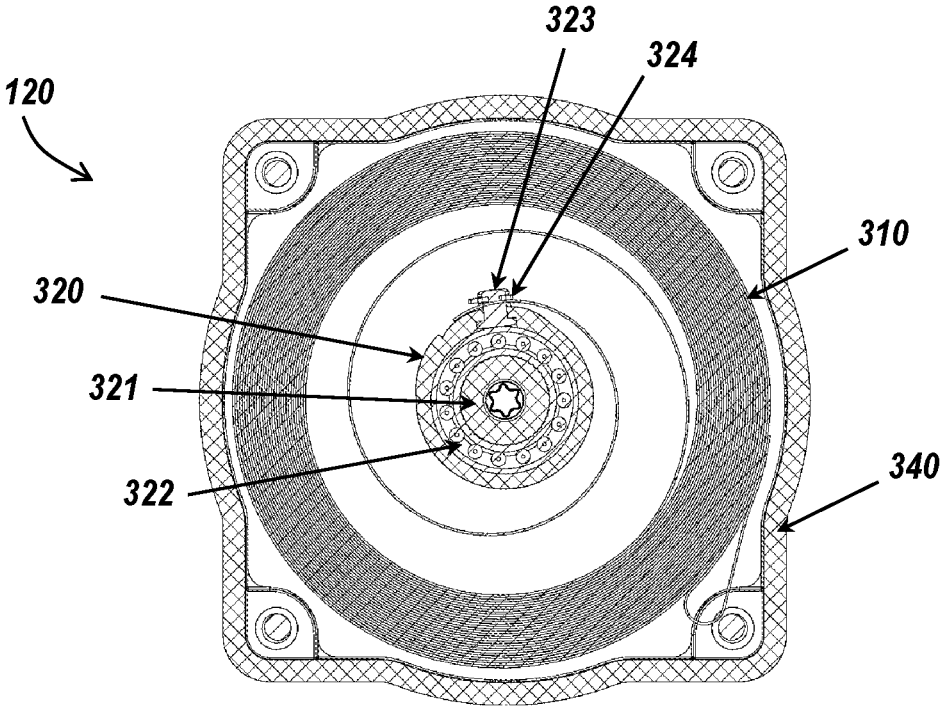

FIGS. 3A-3C illustrate possible features of an exemplary modular spring plate 120. FIG. 3A illustrates a perspective view of a modular spring plate 120, FIG. 3B illustrates a cross-sectional view of a first embodiment of the modular spring plate 120, and FIG. 3C illustrates a cross-sectional view of a second embodiment of the modular spring plate 120. As shown in FIG. 3B, in some embodiments, the modular spring plate 120 includes a power spring 310 mounted on a shaft 320. The shaft 320 may include a male polygon profile on a first side and a female polygon profile on a second side to enable coupling to a base unit 110 and/or additional modular spring plates 120. In some such embodiments, the male polygon profile and the female polygon profile are mating P3 polygon profiles. A screw or other type of fastener may be included to secure the power spring 310 to the shaft 320. However, other configurations are also possible, such as those discussed below with respect to FIG. 3C. Housing components 340 and 350 may be secured together using screws, bolts, or other fasteners to securely retain all internal components inside the modular spring plate 120.

FIG. 3C illustrates an exemplary embodiment of a modular spring plate 120 specifically configured to reduce or eliminate mechanical fatigue on the power spring 310 to increase its lifespan. As discussed below in detail and as shown in FIG. 3C, the shaft 320 within modular spring plate 120 can prevent unwanted stress concentration at the interconnection of the power spring 310 and the shaft 320. In the embodiment shown in FIG. 3C, shaft 320 includes a shaft core 321 with a needle roller clutch bearing 322 seated around the shaft core 321. The shaft core 321 may have a male P3 polygon profile on one side and a female P3 polygon profile on an opposing side, in some embodiments. The shaft core 321 is rotationally coupled to the spool 210 (e.g., via the P3 polygon profile coupling mechanism). The needle roller clutch bearing 322 is able to freely rotate around the shaft core 321 in one direction but mechanically prevented from rotating around the shaft core 321 in the opposite direction.

As shown in FIG. 3C, a spring attachment pin 323 may be fastened to an outside diameter of the needle roller clutch bearing 322 and a retaining clip 324 may be attached to the spring attachment pin 323. The retaining clip 324 fastens the power spring 310 to the spring attachment pin 323. The spring attachment pin 323 transmits the rotation of the needle roller clutch bearing 322 (in the locked direction) to the inside of the power spring 310. Thus, rotation of the shaft core 321 in the winding direction causes the clutch mechanism inside the needle roller clutch bearing 322 to lock up, which causes the power spring 310 to wind up. If the shaft core 321 is rotated in the reverse direction (i.e., the unwinding direction), the needle roller clutch bearing 322 is designed to slip and thereby prevent undesired stress concentration in the power spring 310. This shaft 320 configuration permits the cable training device 100 to function as described elsewhere throughout the disclosure, whereby when the handle 280 is released (after having been pulled), cable 270 is wound back up around spool 210 by the recoil spring 220 to its initial location. This unique spool 320 configuration shown in FIG. 3C, in which a needle roller clutch bearing 322 is attached to an inner end of the power spring 310, presents advantages over other previously known arrangements and results in significantly less mechanical strain on the power spring 310.

The power spring 310 may be configured in any suitable manner to provide the desired level of resistance to the cable 270. In some embodiments, the power spring 310 may be formed of stainless steel (e.g., Type 301 stainless steel) or another type of high-carbon steel. In select embodiments, the power spring 310 may be a 3 inch-pound power spring (for example, having a case ID of 3" or between 2"-6"), a width of 0.5" (or a width of between 0.25"-1.5"), a metal band thickness of 0.011" (or a metal band thickness of between 0.0050"-0.025"), a turn of 34.4 (or a turn of between 25-50), and/or a torque of 7.5 inch-pounds (or a torque of between 1.5 inch-pounds-20.0 inch-pounds). Numerous configurations and variations of power spring 310 are possible and contemplated herein.

The base unit 110 and modular spring plate(s) 120 may be configured to include various features to ensure proper interaction of the components. For example, in some embodiments, one or more modular spring plates 120 may be coupled to the base unit 110 with interlocking ball detents that interface with corresponding tabs. Exemplary ball detents 122 and corresponding tabs 124 are illustrated in FIG. 1B. In embodiments in which ball detents and interlocking tabs are used, modular spring plates 120 can be coupled to the base unit 110 by bringing the components into contact with one another and twisting one or both relative to the other. In some such embodiments, the modular spring plates 120 can be uncoupled from the base unit 110 by twisting as well. Various other types of mechanisms can also be used to couple the modular spring plates 120 to the base unit 110. For example, in some embodiments, magnets may be included in the modular spring plate(s) 120 and the base unit 110 to facilitate attachment. Specifically, in some such embodiments, magnets may be included in housing components 250, 260, 340, and/or 350 to promote coupling of the base unit 110 and the modular spring plate(s) 120. In these and other embodiments, male pins may be included on the face of the modular spring plates 120 to fit into holes on the base unit 110 to prevent axial movement of the modular spring plate 120 relative to the base unit 110. In these and other embodiments, female-male P3 (or other) polygon profiles may be used to couple the rotational movement of the spool 210 within the base unit 110 to the shaft 320 within the modular spring plate 120. In some embodiments, to prevent a modular spring plate 120 attached to a base unit 110 from rotating during use, one or more fasteners (e.g., socket head cap screw heads) may be attached to the housing of the modular spring plate 120 (as shown in FIG. 3A). In some such embodiments, 4¼"-20" socket head cap screw heads may be used. Numerous configurations and variations are possible and within the scope of the subject disclosure.

It is to be understood that the presently disclosed cable training devices are not limited to the particular embodiments illustrated in the accompanying drawings and described in detail here. Numerous alternative embodiments will be apparent to those skilled in the art upon consideration of the subject disclosure.

Exemplary Methods

Figure 4:
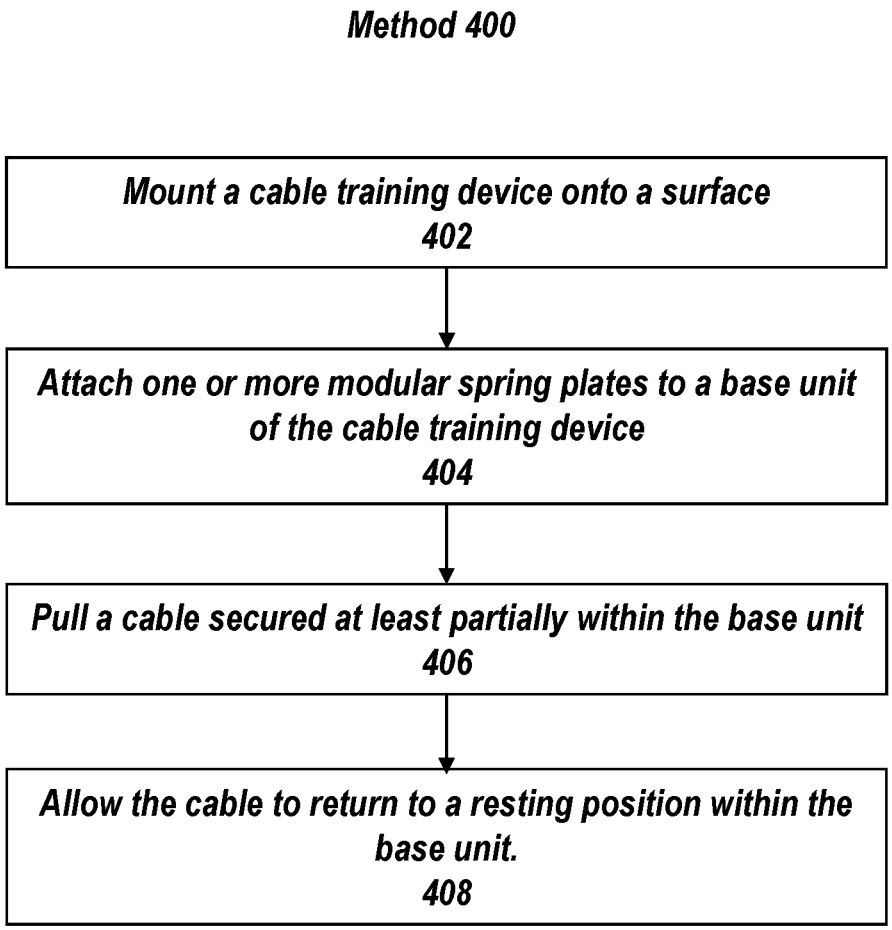
FIG. 4 illustrates an exemplary method of use for the presently disclosed cable training devices.

FIG. 4 illustrates an exemplary method 400 of using the presently disclosed cable training devices. As shown in FIG. 4, method 400 includes mounting the cable training device onto a surface (Block 402). The disclosed cable training device can be mounted on any desired surface, such as a wall, floor, ceiling, furniture surface, or any sturdy and stable structure suitable for supporting the cable exercise device. Any suitable type of mounting technique may be used in the disclosed methods. In some embodiments, to mount the cable training device, a modular mount 130 may be attached to a base unit 110 using a fastener 140 (as shown in FIG. 1A).

Method 400 of FIG. 4 continues with attaching one or more modular spring plates to a base unit of the cable training device (Block 404). Modular spring plates 120 may be attached to a base unit 110 of the cable training device to reach a desired resistance level. In some embodiments, at least one, two, three, four, five, six, or more modular spring plates 120 are attached to the base unit 110. The desired number of modular spring plates may be attached to the base unit without the assistance of tools, in some embodiments.

Method 400 of FIG. 4 continues with pulling a cable secured at least partially within the base unit (Block 406). When pulling the cable, the user may grasp a handle 280 or another connective feature. As the cable is pulled, spool 210 rotates and this rotation is translated out of the base unit 110 and into the modular spring plate(s) 120 (through female-male P3 polygon coupling or another coupling mechanism). Method 400 of FIG. 4 continues with allowing the cable to return to a resting position within the base unit (Block 408).

As will be appreciated, when the cable 270 is pulled, it unwinds, making spool 210 rotate. As spool 210 rotates, recoil spring 220 (which is attached to spool 210) winds up. When the cable 270 is released after being pulled, the cable 270 is automatically wound back up around spool 210 by recoil spring 220 until it returns to its initial location.

When coupled to the base unit 110, the modular spring plate(s) 120 provide additional resistance to cable 270. Shaft 320 within the modular spring plate 120 is coupled to the spool 210 within the base unit 110 and maintains the rotational properties previously described with respect to spool 210. The rotation of shaft 320 thus causes a power spring 310 within the modular spring plate 120 to wind up. When the cable 270 is released from being pulled, the cable is automatically wound around spool 210 by recoil spring 220 and power spring 310 until the cable 270 returns to its initial location.

While some exemplary embodiments of cable training devices and related methods embodying aspects of the subject disclosure have been shown in the drawings, it is to be understood that this disclosure is for the purpose of illustration only, and that various changes in shape, proportion and arrangement of parts as well as the substitution of equivalent elements for those shown and described herein may be made without departing from the spirit and scope of the disclosure.

Additional Componentry

Figure 5A:
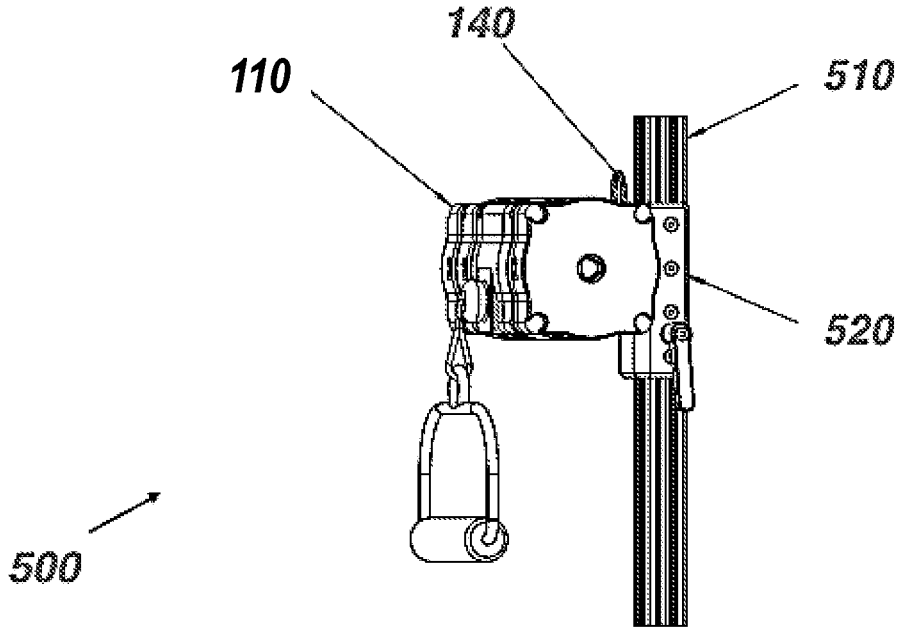
FIGS. 5A and 5B illustrate an exemplary track mount device configured in accordance with embodiments of the subject disclosure. In particular.
Figure 5B:
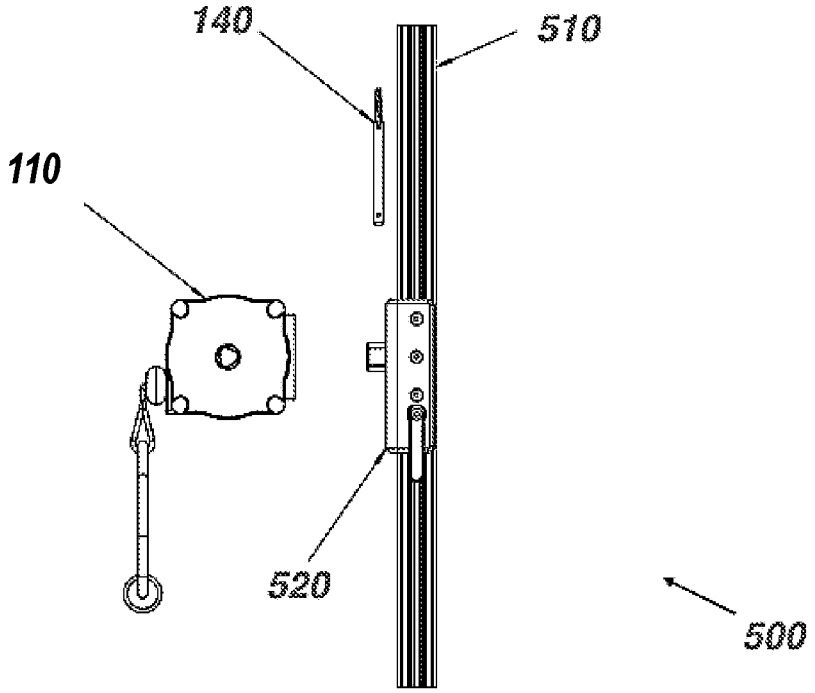

FIGS. 5A and 5B illustrate an exemplary track mount device 500. As shown in FIGS. 5A and 5B, track mount device 500 includes a traveler 520 that moves axially along t-slotted framing 510 that has been permanently mounted to a sturdy structure. Base unit 110 (as previously described herein) attaches to traveler 520 using fastener 140. One or more modular spring plates 120 may be coupled to the base unit 110, as desired using devices and techniques previously discussed. Traveler 520 can be fastened at any location along the t-slotted framing 510 for the optimal desired position.

Figure 6A:
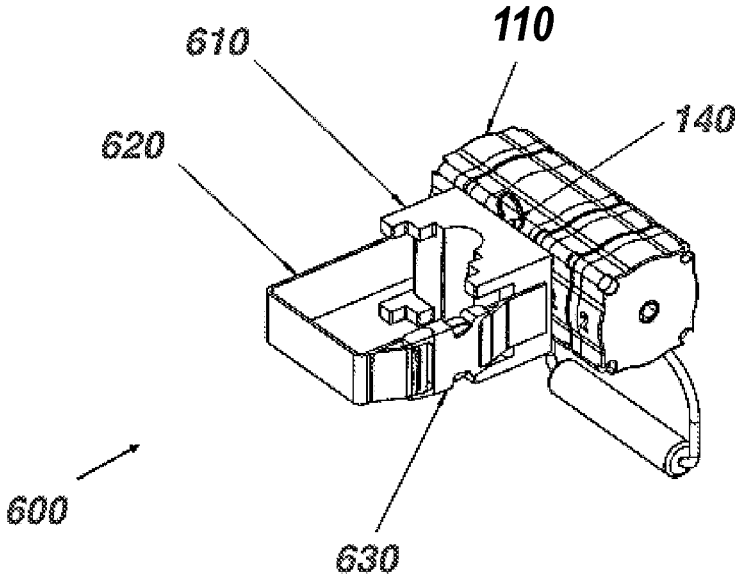
FIGS. 6A and 6B illustrate an exemplary strap mount device configured in accordance with embodiments of the subject disclosure. In particular.
Figure 6B:
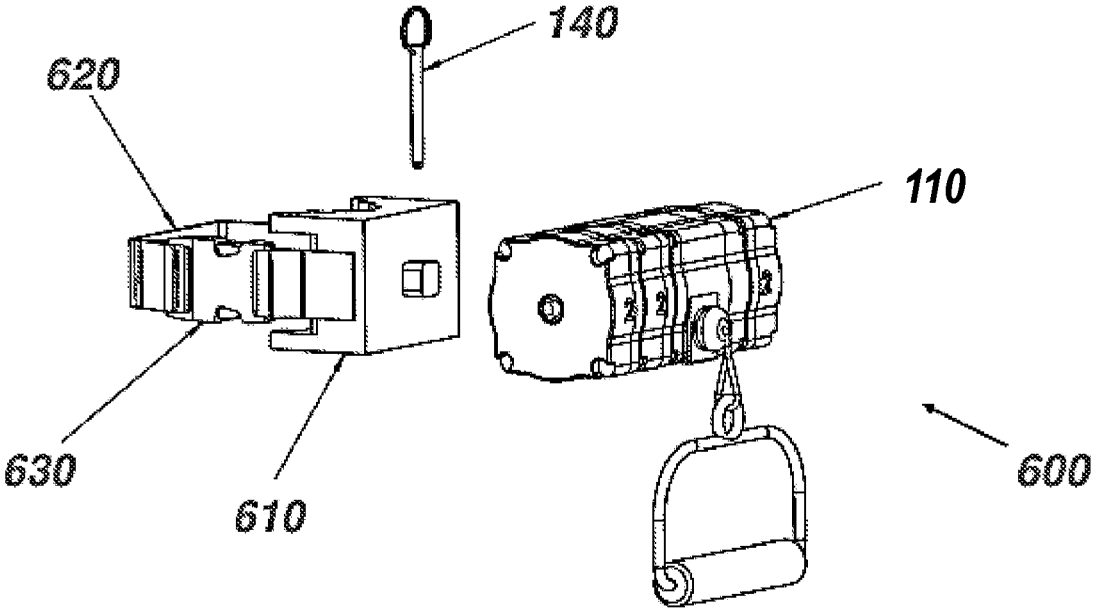

FIGS. 6A and 6B illustrate an exemplary strap mount device 600. As shown in FIGS. 6A and 6B, the strap mount device 600 uses a strap 620 with a clasp 630 attached to the base attachment plate 610. The strap 620 may be wrapped around any pole, beam, or sturdy structure (not shown) and then tightened by attaching and pulling strap 620 with clasp 630. The base attachment plate 610 is attachable to base unit 110 using fastener 140.

The invention claimed is:

1. A modular resistance device comprising:

a base unit comprising a cable wound around a spool and a recoil spring coupled to the spool such that the recoil spring exerts a resistive force upon the spool to resist unwinding of the cable from the spool;

a first modular spring plate comprising a first power spring mounted on a first shaft, wherein the first modular spring plate is couplable to and decouplable from the base unit; and a second modular spring plate comprising a second power spring mounted on a second shaft, wherein the first modular spring plate is attachable to a first side of the base unit and the second modular spring plate is attachable to a second side of the base unit via the second shaft and the first side of the base unit is opposite the second side of the base unit, and wherein the resistive force applied to the cable increases when the first modular spring plate is coupled to the base unit and the resistive force applied to the cable decreases when the first modular spring plate is decoupled from the base unit.

2. The modular resistance device of claim 1, wherein the base unit further comprises a housing, the spool is retained within the housing, and the cable extends at least partially outside of the housing.

3. The modular resistance device of claim 1, wherein the spool has an axis shaped to mate with an axis of the first modular spring plate.

4. The modular resistance device of claim 3, wherein the axis of the spool is shaped as a female polygon and the axis of the first modular spring plate is shaped as a mating male polygon.

5. The modular resistance device of claim 1, wherein the first shaft includes a male polygon profile on a first side of the first modular spring plate and a female polygon profile on a second side of the modular spring plate opposite the first side.

6. The modular resistance device of claim 5, wherein the first side of the modular spring plate is directly attachable to and removable from the base unit.

7. The modular resistance device of claim 6 further comprising wherein the second shaft includes a male polygon profile configured to mate with the female polygon profile of the first modular spring plate or a female polygon profile of the spool of the base unit.

8. The modular resistance device of claim 1, wherein the spool has a tapered barrel.

9. The modular resistance device of claim 1, wherein the base unit is couplable to and removeable from a modular mount.

10. The modular resistance device of claim 9, wherein the modular mount is selected from the group consisting of: a physical wall mount, an easy on/off magnet mount, a pole mount, a post mount, a tree mount, a fence mount, and a suction cup.

11. The modular resistance device of claim 1, wherein the first modular spring plate is attachable to the base unit with interlocking ball detents and mating tabs.

12. The modular resistance device of claim 1, wherein the cable in implemented with a high-modulus polyethylene (HMPE).

13. The modular resistance device of claim 12, wherein the cable implements the HMPE as an HMPE core with a polyester cover.

14. The modular resistance device of claim 1, wherein the cable has a length of between six and twelve feet.

15. The modular resistance device of claim 1, wherein the first shaft comprises a shaft core with a needle roller clutch bearing seated around the shaft core, wherein an inner end of the first power spring is attached to the needle roller clutch bearing.

16. The modular resistance device of claim 15, wherein the needle roller clutch bearing is able to freely rotate around the shaft core in a first direction but mechanically prevented from rotating around the shaft core in a second direction opposite from the first direction.

* * * * *